US012642341B2

(12) United States Patent
Fields et al.

(10) Patent No.: US 12,642,341 B2
(45) Date of Patent: Jun. 2, 2026

(54) FOOT TREATMENT APPARATUS

(71) Applicants: Arnold Fields, Chesapeake, VA (US); Myra Fields, Chesapeake, VA (US)

(72) Inventors: Arnold Fields, Chesapeake, VA (US); Myra Fields, Chesapeake, VA (US)

( * ) Notice: Subject to any disclaimer, the term of this patent is extended or adjusted under 35 U.S.C. 154(b) by 209 days.

(21) Appl. No.: 18/379,756

(22) Filed: Oct. 13, 2023

(65) Prior Publication Data

US 2025/0120490 A1 Apr. 17, 2025

(51) Int. Cl.
*A45D 29/02* (2006.01)

(52) U.S. Cl.
CPC ..... *A45D 29/02* (2013.01); *A45D 2200/1054* (2013.01)

(58) Field of Classification Search
None
See application file for complete search history.

(56) References Cited

U.S. PATENT DOCUMENTS 4,847,994 A * 7/1989 Dunn, Jr. ..... A45D 29/02 30/28
4,893,406 A * 1/1990 Larson ..... A45D 29/02 30/297
5,775,340 A * 7/1998 Rains ..... A61B 17/54 30/28
6,539,632 B2 * 4/2003 Anctil ..... A61B 17/54 30/28
6,601,587 B2 * 8/2003 Shaw ..... A45D 29/18 132/75.3
11,571,057 B2 * 2/2023 Daugherty ..... A45D 29/02
2018/0279739 A1 * 10/2018 Kim ..... A45D 29/02
2025/0120490 A1 * 4/2025 Fields ..... A45D 29/02

FOREIGN PATENT DOCUMENTS

DE 20213500 U1 * 11/2002 ..... A45D 29/02
EP 1607019 A1 * 12/2005 ..... B65D 21/0201
KR 20230001549 U * 7/2023 ..... A45D 29/02

OTHER PUBLICATIONS

English translation of DE-20213500-U1, dated Nov. 21, 2002.*
English translation of KR-20230001549-U, dated Jul. 28, 2023.*

* cited by examiner

*Primary Examiner* — Hwei-Siu C Payer

(57) ABSTRACT

A foot treatment apparatus for clipping toenails from a distance away from the toenails includes a rod with a nail clipper mounted to an end of the rod. An actuator is mounted to the rod as is operable to move a lever of the nail clipper to clip a toenail. An input for the actuator is positioned at another end of the rod so that the nail clipper may be operated from a distance.

17 Claims, 9 Drawing Sheets

FOOT TREATMENT APPARATUS

(b) CROSS-REFERENCE TO RELATED APPLICATIONS

Not Applicable

(c) STATEMENT REGARDING FEDERALLY SPONSORED RESEARCH OR DEVELOPMENT

Not Applicable

(d) THE NAMES OF THE PARTIES TO A JOINT RESEARCH AGREEMENT

Not Applicable

(e) INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

(f) STATEMENT REGARDING PRIOR DISCLOSURES BY THE INVENTOR OR JOINT INVENTOR

Not Applicable

(g) BACKGROUND OF THE INVENTION

(1) Field of the Invention

The disclosure relates to nail clippers and more particularly pertains to a new nail clipper for clipping toenails from a distance away from the toenails.

(2) Description of Related Art including information disclosed under 37 CFR 1.97 and 1.98

The prior art describes myriad nail clippers but fails to disclose a nail treatment apparatus which facilitates clipping the toenails from a distance away from the toenails. Such an apparatus is advantageous over the prior art in that it allows a user to clip their own toenails without bending as far as they would otherwise require. Such advantages would be particularly advantageous to those with limited flexibility, conditions such as arthritis, and other physical limitations.

(h) BRIEF SUMMARY OF THE INVENTION

An embodiment of the disclosure meets the needs presented above by generally comprising a rod which has a perimeter surface that extends between a top end and a bottom end of the rod. A nail clipper is coupled to the rod at the bottom end. The nail clipper comprises a first blade, a second blade, and a lever. The lever is movable to move the first and second blades toward each other to shear a toenail. An actuator is mounted to the rod which is operable to move the lever of the nail clipper to urge the first and second blades toward each other when the nail clipper is coupled to the rod.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

(i) BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

(j) DETAILED DESCRIPTION OF THE INVENTION

Figure 1:
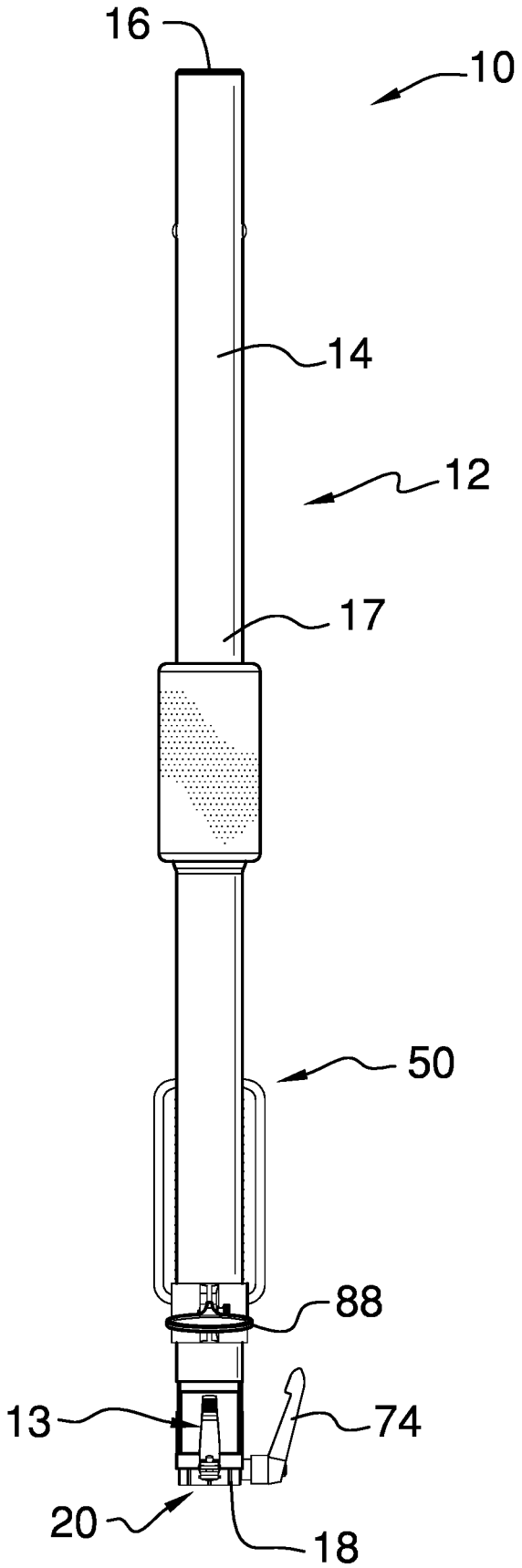
FIG. 1 is a front view of a foot treatment apparatus according to an embodiment of the disclosure.
Figure 2:
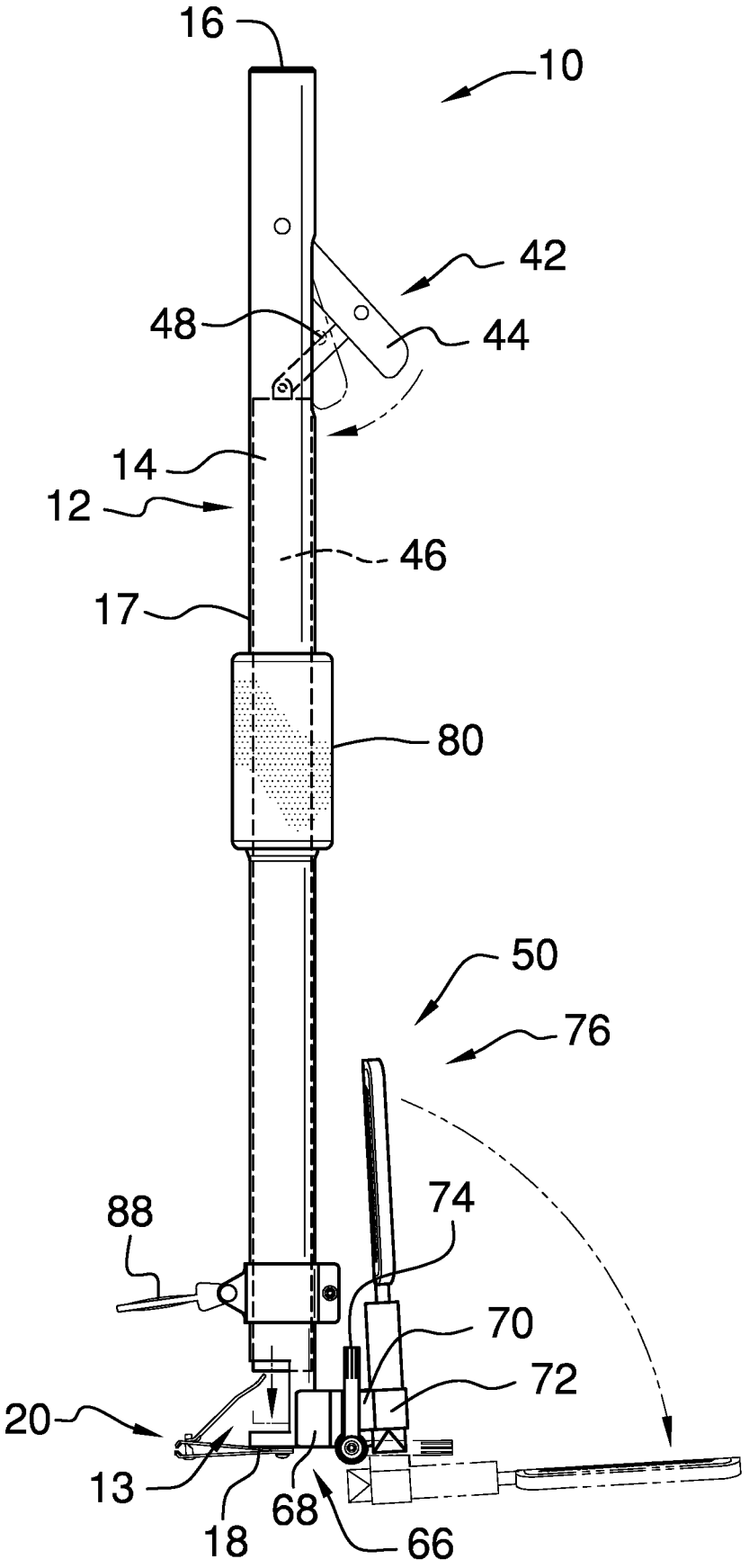
FIG. 2 is a side view of an embodiment of the disclosure.
Figure 3:
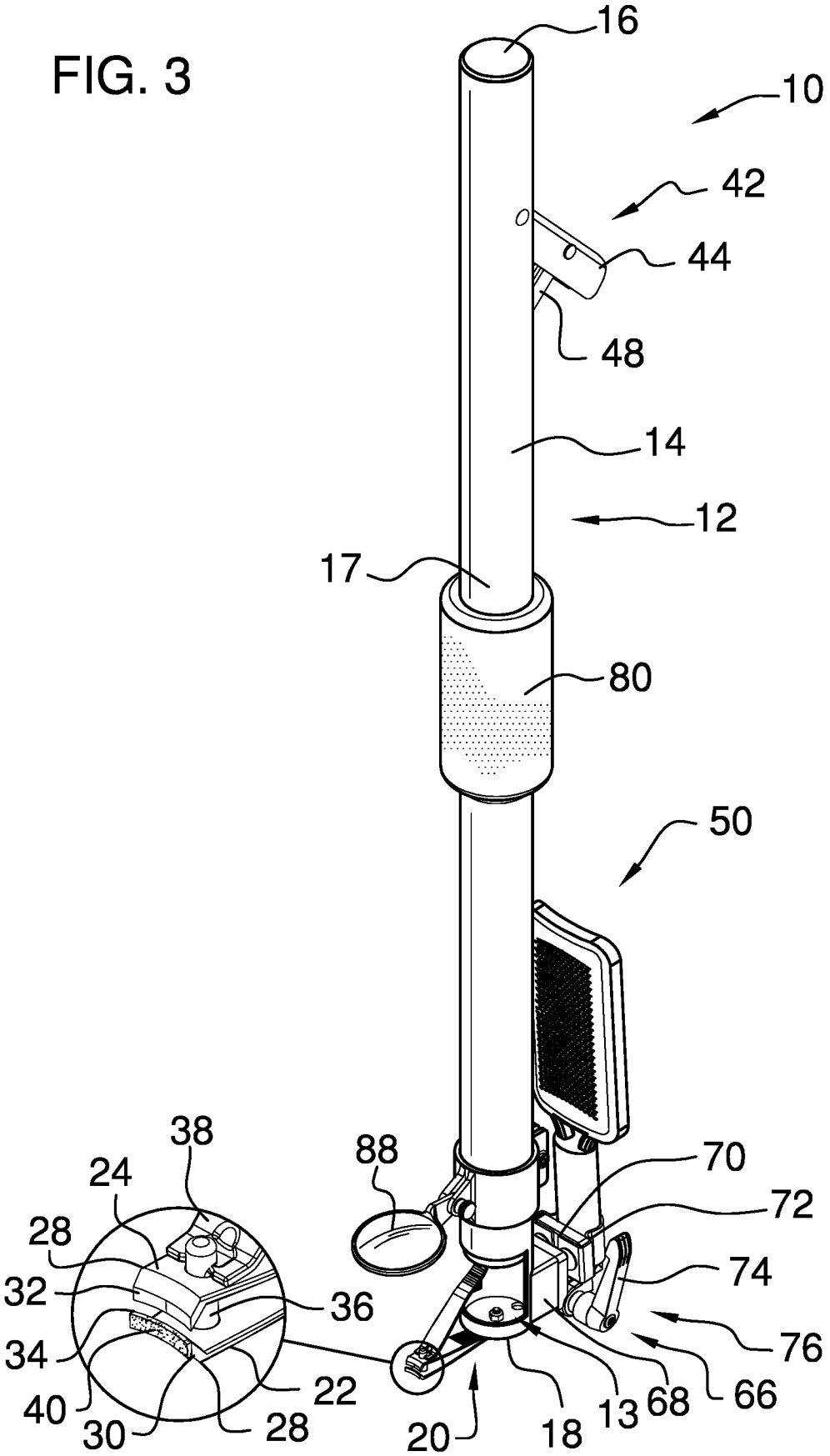
FIG. 3 is a perspective view of an embodiment of the disclosure.
Figure 4:
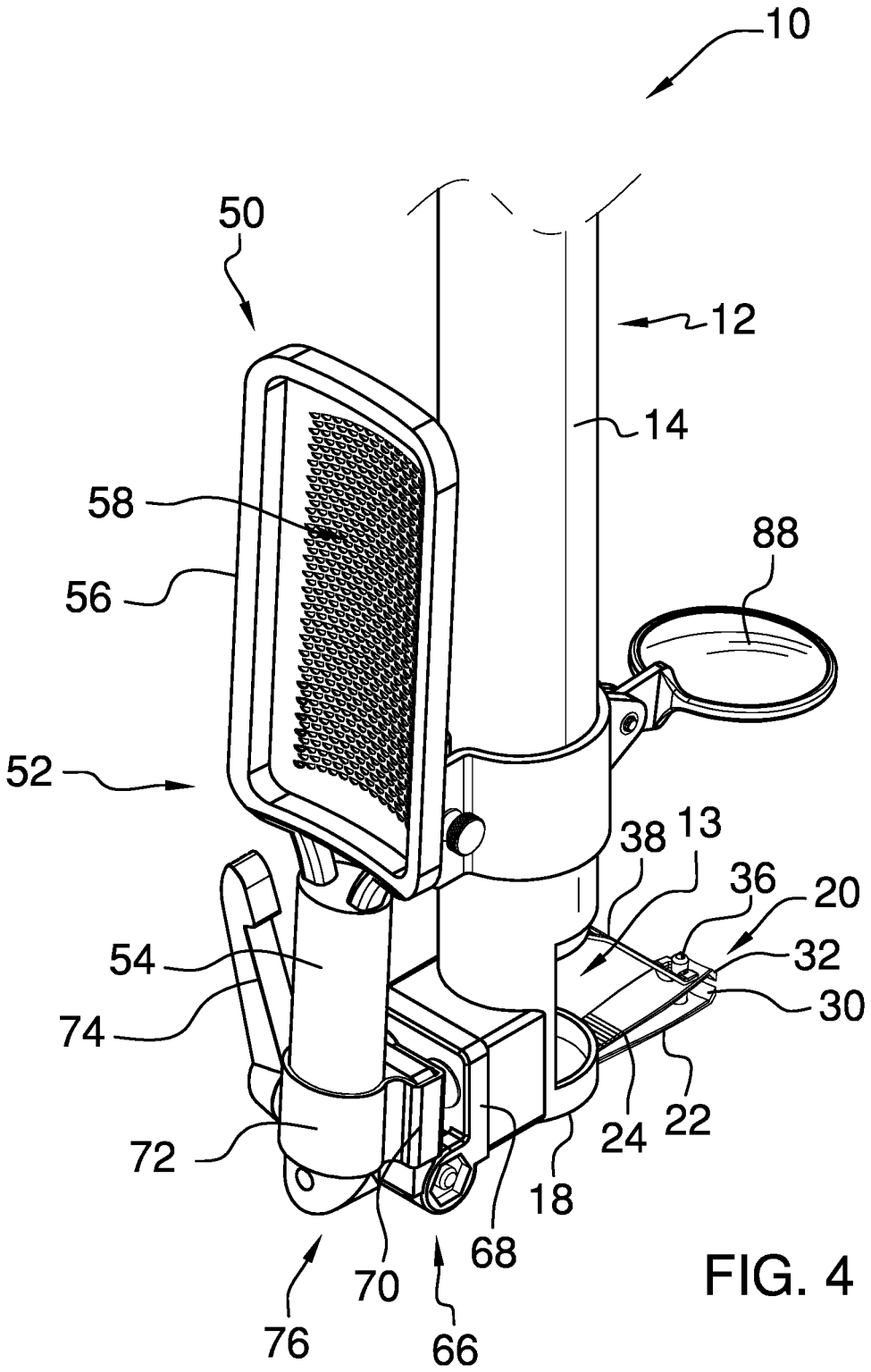
FIG. 4 is a perspective detail view of an embodiment of the disclosure.
Figure 5:
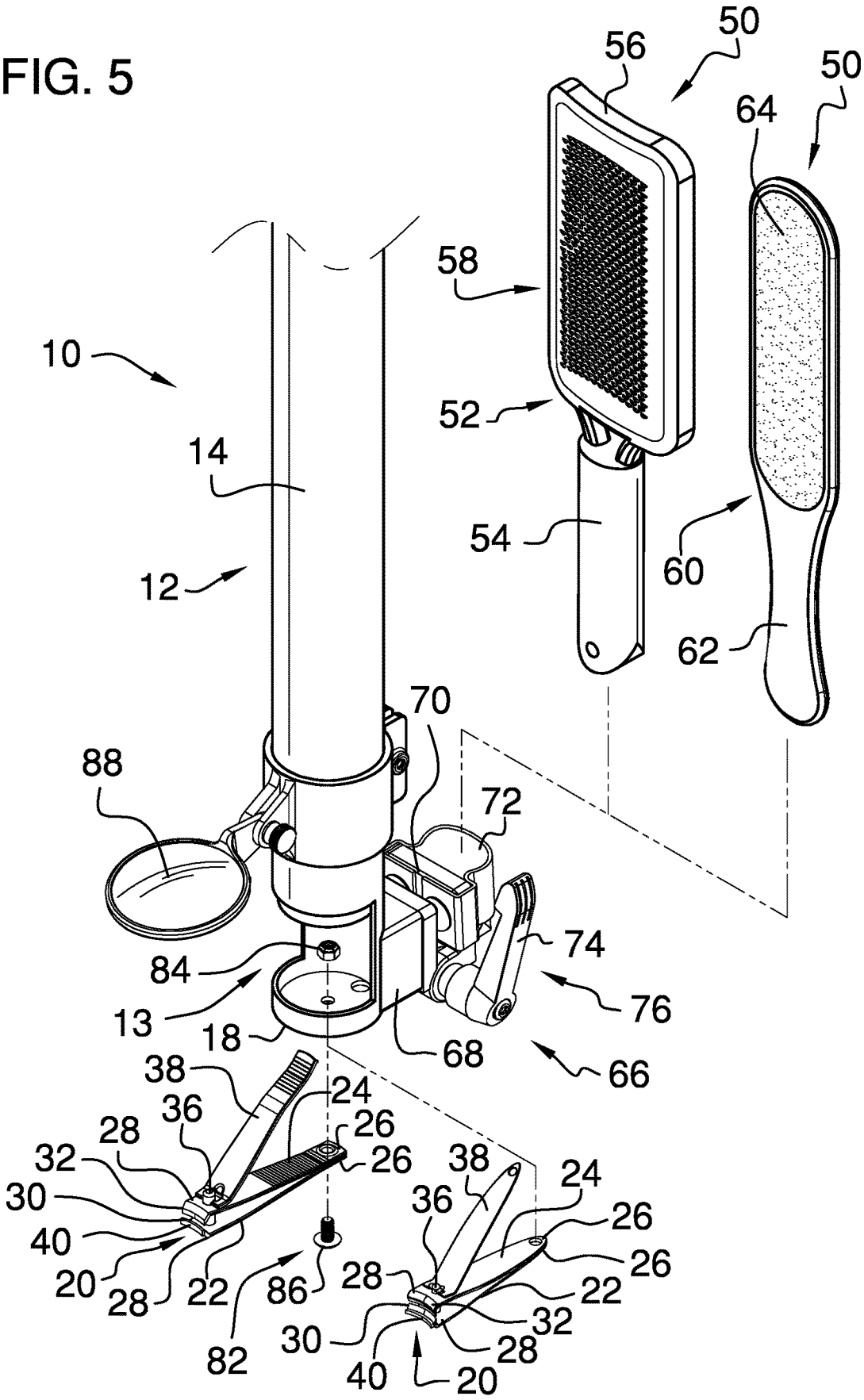
FIG. 5 is a perspective exploded view of an embodiment of the disclosure.
Figure 6:
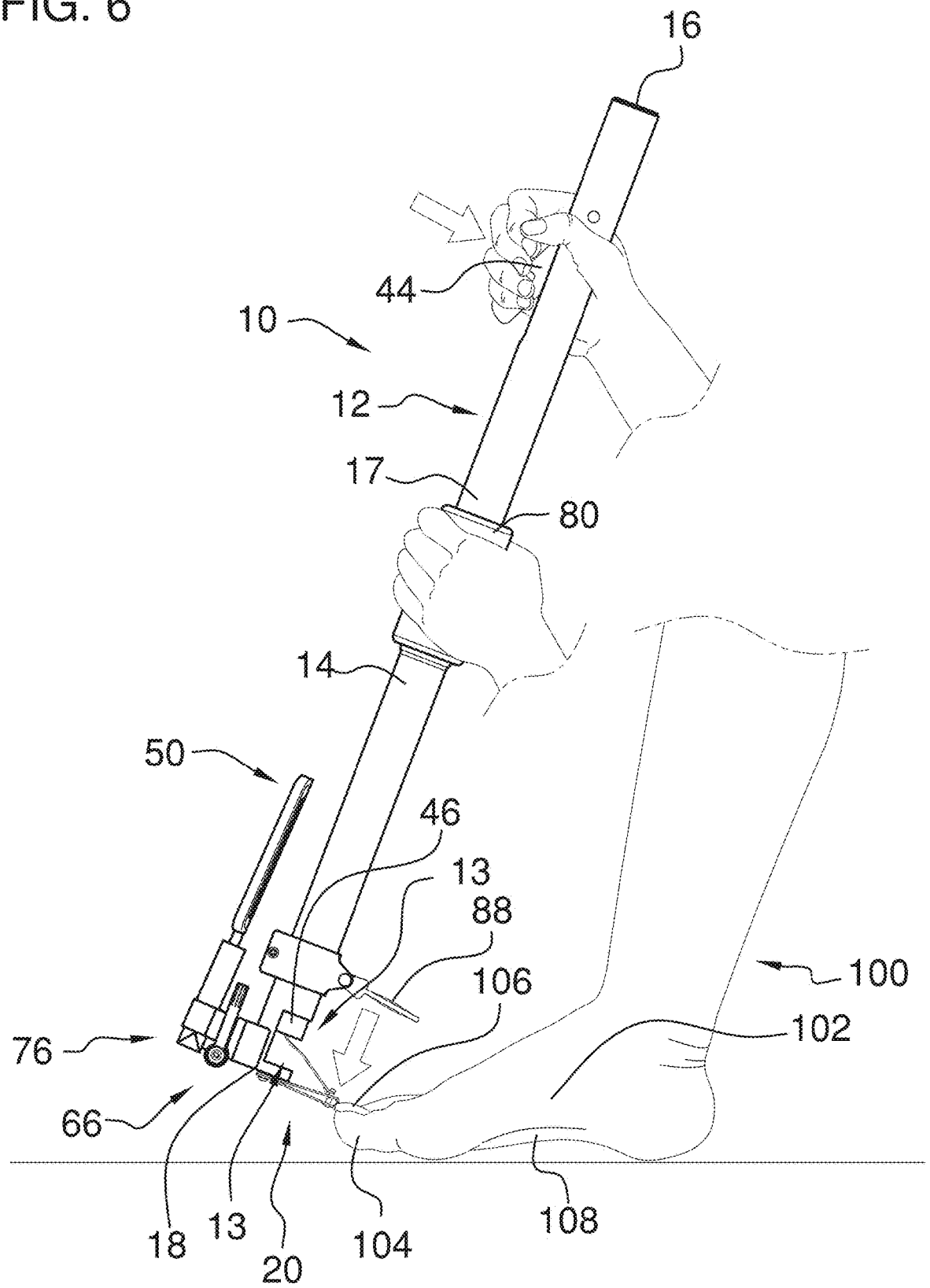
FIG. 6 is an in-use view of an embodiment of the disclosure.
Figure 7:
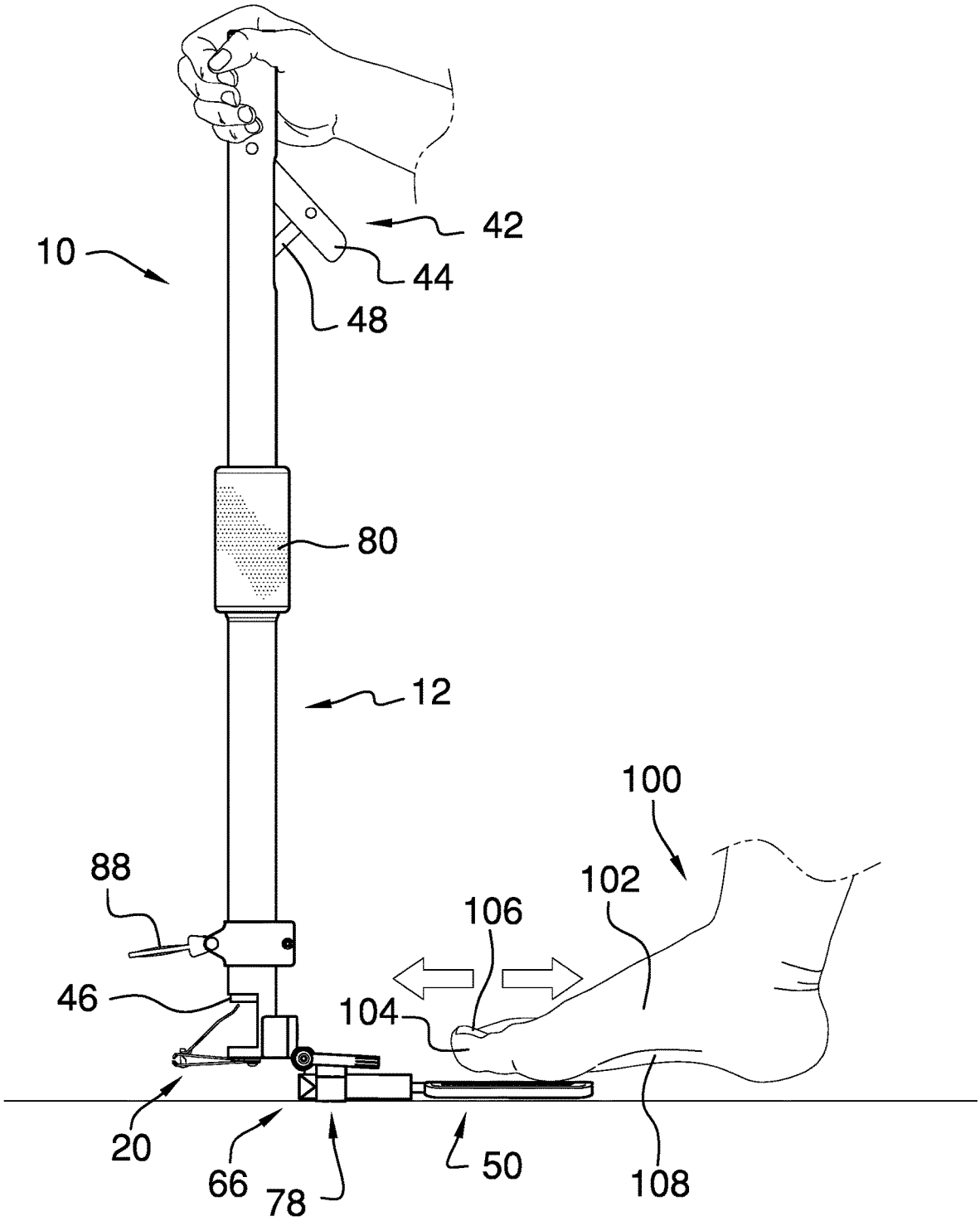
FIG. 7 is an in-use view of an embodiment of the disclosure.

With reference now to the drawings, and in particular to FIGS. 1 through 9 thereof, a new nail clipper embodying the principles and concepts of an embodiment of the disclosure and generally designated by the reference numeral 10 will be described.

As best illustrated in FIGS. 1 through 9, the foot treatment apparatus 10 generally comprises a rod 12 with a perimeter surface 14 extending between a top end 16 and a bottom end 18 of the rod 12. A pair of nail clippers 20 is interchangeably couplable to the rod 12 at the bottom end 18, each nail clipper 20 of the pair of nail clippers 20 comprises a first arm 22 and which coupled together at joined ends 26 of the first and second arms 22, 24. Each one of the first and second arms 22, 24 has an uncoupled end 28. The uncoupled ends 28 of the first and second arms 22, 24 are positioned adjacent to each other and are biased away from each other. Each nail clipper 20 also comprises a first blade 30 and a second blade 32. The first blade 30 is coupled to the uncoupled end 28 of the first arm 22, and the second blade 32 is coupled to the uncoupled end 28 of the second arm 24. Shearing edges 34 of the first and second blades 30, 32 facing toward each other. Each nail clipper 20 further includes a pin 36, a lever 38, and a spacer 40. The pin 36 is coupled to and extends away from the first arm 22 and through the second arm 24. The lever 38 is pivotally coupled to the pin 36 opposite the second arm 24. The lever 38 is movable against the first arm 22 to move the first and second blades 30, 32 toward each other. The spacer 40 is coupled to a front surface of the first blade 30 and is configured to abut skin of a toe and retain the skin away from the shearing edge 34 of the first blade 30. The spacer 40 may include felt, rubber, silicone, another polymer, or the like.

The rod 12 defines an opening 13 in the perimeter surface 14 adjacent to the bottom end 18. When a selected nail clipper 20 of the pair of nail clippers 20 is coupled to the rod 12, the lever 38 of the selected nail clipper 20 extends through the opening 13 of the perimeter surface 14 of the rod 12. The first blades 30 of the pair of nail clippers 20 differ in length with respect to each other, and the second blades 32 of the pair of nail clippers 20 differing in length with respect to each other.

An actuator 42 is mounted to the rod 12 and is operable to move the lever 38 of the selected nail clipper 20 against the second arm 24 of the selected nail clipper 20 when the selected nail clipper 20 is coupled to the rod 12. The actuator 42 comprises an actuator handle 44, a slider 46, and a link 48. The actuator handle 44 is pivotally coupled to the rod 12 and is positioned closer to the top end 16 of the rod 12 than the bottom end 18. The slider 46 is slidably coupled to the rod 12 and is positioned in the rod 12. The link 48 is pivotally coupled to and extends between the actuator handle 44 and the slider 46. The actuator handle 44 is movable toward the rod 12 to urge the slider 46 via the link 48 to move the lever 38 of the selected nail clipper 20 against the second arm 24 of the selected nail clipper 20 when the selected nail clipper 20 is coupled to the rod 12. In other embodiments, the actuator handle 44 may be fixed to the slider 46 and slidable to urge the slider 46 against the lever 38.

A pair of abrasion tools 50 is interchangeably couplable to the rod 12 at the bottom end 18. The pair of abrasion tools 50 includes a rasp 52 and a scrubber 60. The rasp 52 comprises a rasp handle 54 and a rasp head 56, wherein the rasp handle 54 is coupled to the rasp head 56 and the rasp head 56 has a plurality of cutting edges 58. The scrubber 60 comprises a scrubber handle 62 and a scrubber head 64. The scrubber head 64 comprises an abrasive material such that the scrubber head 64 is configured to abrade a sole of a foot. The abrasive material may comprise sandpaper, pumice, or the like. The scrub head may also have a friction enhancing surface structure. Either abrasion tool 50 may be used to abrade the sole of the foot to exfoliate the sole, remove callouses, or the like. In the case of the rasp 52, callouses may be removed by cutting rather than abrading.

A mount 66 is coupled to the rod 12 at the bottom end 18. The mount 66 comprises a first member 68, a second member 70, a sleeve 72, and a position lock 74. The first member 68 is fixedly attached to the rod 12, and the second member 70 is pivotally coupled to the first member 68. The sleeve 72 is coupled to the second member 70. The abrasion tools 50 are interchangeably insertable into the sleeve 72 to be held by the mount 66. The position lock 74 is coupled to the first member 68 and the second member 70 to secure the first member 68 with respect to the second member 70. The position lock 74 may include, for example, a fastener which tightens the first member 68 and the second member 70 together when rotated with respect to the first and second members 68, 70 to enhance friction between the first member 68 and the second member 70. The mount 66 is movable to move a selected abrasion tool 50 of the pair of abrasion tools 50 between a first position 76 and a second position 78 when the selected abrasion tool 50 is held in the sleeve 72. The selected abrasion tool 50 lies adjacent to the rod 12 when the abrasion tool 50 is positioned in the first position 76 and extends perpendicularly away from the rod 12 when the abrasion tool 50 is positioned in the second position 78.

A grip 80 is coupled to the rod 12. The grip 80 is extends around the perimeter surface 14 of the rod 12 and is positioned on a central portion 17 of the rod 12. The grip 80 is made of a resilient material such as rubber, polyurethane, silicone, or the like, so that the grip 80 may be compressed when grasped by a hand to enhance friction between the grip 80 and the hand. A clipper connector 82 is interchangeably connectable to either one of the pair of nail clippers 20 to couple either nail clipper 20 to the rod 12. The clipper connector 82 comprises a nut 84 and a bolt 86 having complementary threads. In some embodiments, the clipper connector 82 may comprise a latch, a clamp, a snap fit connection, or the like.

In reference to FIGS. 1 through 7, a first embodiment further comprises a magnifying glass 88 which is coupled to the rod 12 adjacent to the bottom end 18. The magnifying glass 88 is positioned over the first and second blades 30, 32 of the selected nail clipper 20 when the selected nail clipper 20 is coupled to the rod 12. The magnifying glass 88 is also pivotable with respect to the rod 12.

Figure 8:
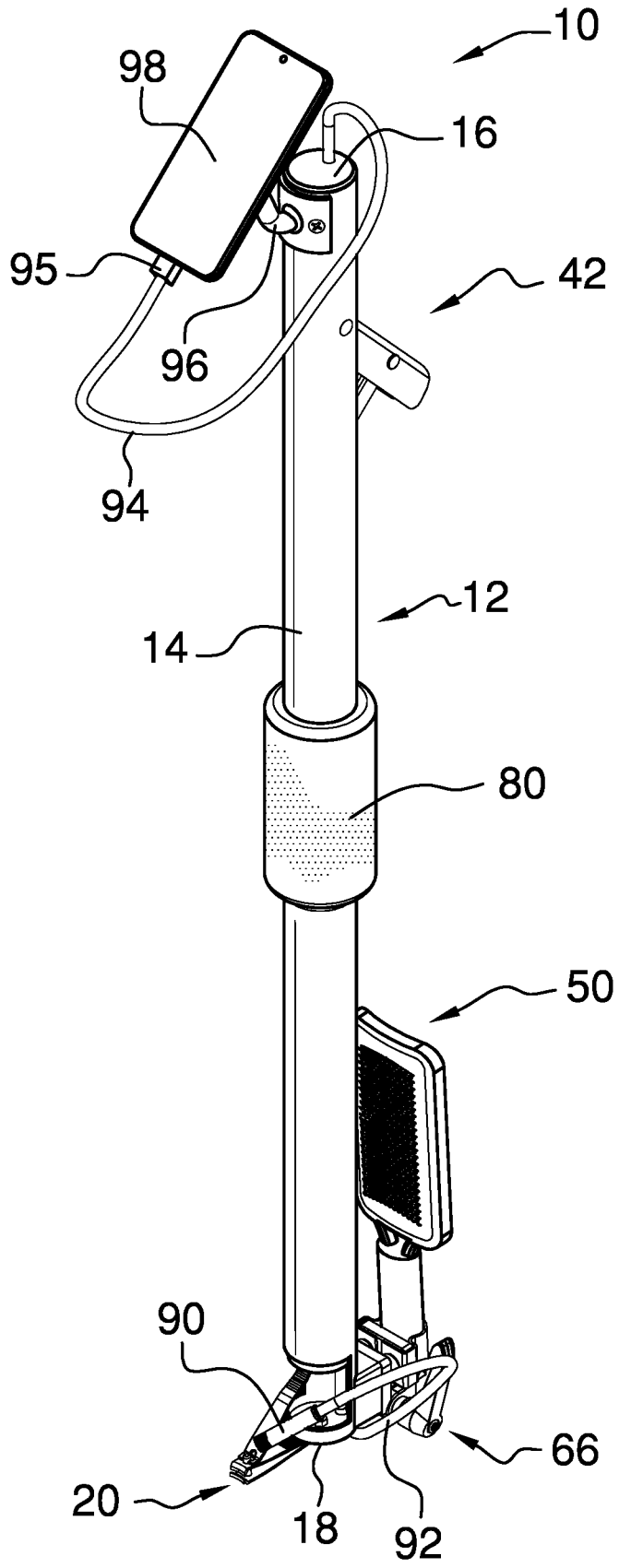
FIG. 8 is a perspective view of an embodiment of the disclosure.
Figure 9:
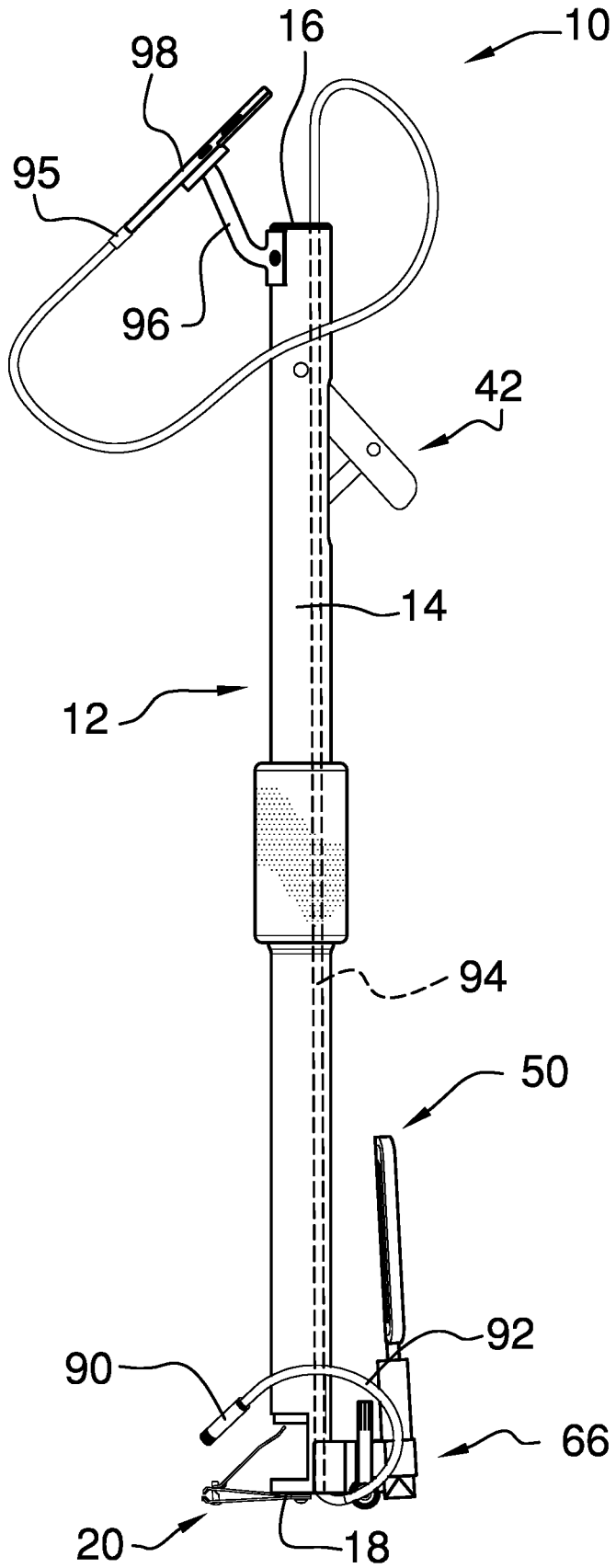
FIG. 9 is a side view of an embodiment of the disclosure.

In reference to FIGS. 8 and 9, a second embodiment further comprises a camera 90 coupled to the rod 12 which is positionable to face the first and second blades 30, 32 of the selected nail clipper 20 when the nail clipper 20 is coupled to the rod 12. The second embodiment also comprises a support 92, an electrical cord 94, and a device holder 96. The support 92 is coupled to the camera 90 and the rod 12 and couples the camera 90 to the rod 12. The support 92 comprises a plastically bendable material, such as a metal wire, such that the support 92 retains a selected shape.

An electrical cord 94 is coupled to the camera 90 and extends from the camera 90, into the rod 12 through the bottom end 18, and out of the rod 12 through the top end 16. The support 92 runs along a portion of the electrical cord 94. In some embodiments, the support 92 may be embedded in the electrical cord 94. A free end 95 of the electrical cord 94 is configured to electrically couple to an electronic device 98 to transmit video to the electrical device and receive operational commands from the electronic device 98 via the electrical cord 94. In some embodiments, the camera 90 may communicate with the electronic device 98 wirelessly.

The device holder 96 is coupled to the rod 12 adjacent to the top end 16. The device holder 96 comprises a magnet wherein the device holder 96 is configured to hold the electronic device 98 via magnetic adhesion. In some embodiments, the device holder 96 may comprise a clip, a pouch, a hook-and-loop fastener, or the like to hold the electronic device 98. In some embodiments, a separate display and a separate control means may be mounted to the rod 12 for viewing images captured by the camera 90 and controlling the camera 90.

In use, the selected nail clipper 20 is attached to the rod 12 at the bottom end 18. A user 100 holds the rod 12 so that the bottom end 18 of the rod 12 is positioned near one of the user's 100 feet 102. The user 100 selects one of the toenails 106 of the foot 102 to clip and places the selected nail clipper 20 to receive the selected toenail 106 between the first blade 30 and the second blade 32 of the selected nail clipper 20. The actuator handle 44 is moved toward the rod 12 to cause the lever 38 of the selected nail clipper 20 to move, thereby urging the first and second blades 30, 32 of the selected nail clipper 20 together to clip the selected toenail 106. The spacer 40 may be positioned in abutment with the toe 104 associated with the selected toenail 106 to prevent the skin of the toe 104 from being damaged by the selected nail clipper 20.

In embodiments with the magnifying glass 88, the user 100 may view the selected toenail 106 through the magnifying glass 88 during use of the foot 102 treatment apparatus 10 to precisely clip the selected toenail 106. In embodiments with the camera 90, video or still images may be viewed on the electronic device 98 or the separate display to precisely clip the selected toenail 106.

The selected abrasive tool is inserted into the sleeve 72 of the mount 66 and positioned in a desired position such that the user 100 may reach the sole 108 of the foot 102 with the selected abrasion tool 50 while holding the rod 12. For example, the mount 66 may be positioned in the second position 78 so that the selected abrasive tool extends perpendicularly away from the rod 12. The position lock 74 may be used to secure the first member 68 of the mount 66 with respect to the second member 70. So positioned, the user 100 abrades the sole 108 of the foot 102 via the abrasion tool 50 to exfoliate the sole 108, remove callouses from the sole 108, or the like.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

We claim:

1. A foot treatment apparatus comprising:

a rod, the rod having a perimeter surface extending between a top end and a bottom end of the rod;

a nail clipper being coupled to the rod at the bottom end, the nail clipper comprising a first blade, a second blade, and a lever, the lever being movable to move the first and second blades toward each other; and an actuator being mounted to the rod, the actuator being operable to move the lever of the nail clipper to urge the first and second blades toward each other when the nail clipper is coupled to the rod;

an abrasion tool being coupled to the rod at the bottom end, the abrasion tool being configured to abrasively engage a sole of a foot; and a mount being coupled to the rod at the bottom end, the mount comprising:

a first member being fixedly attached to the rod;

a second member being pivotally coupled to the first member;

a sleeve being coupled to the second member, the abrasion tool being one of a pair of abrasion tools being interchangeably insertable into the sleeve; and wherein the mount is movable to move the abrasion tool of the pair of abrasion tools between a first position and a second position when the abrasion tool is held in the sleeve, the abrasion tool lying adjacent to the rod when the abrasion tool is positioned in the first position, the abrasion tool extending perpendicularly away from the rod when the abrasion tool is positioned in the second position.

2. The apparatus of claim 1, wherein the nail clipper further comprises a spacer being coupled to a front surface of the first blade, the spacer being configured to abut skin of a toe and retain the skin away from a shearing edge of the first blade.

3. The apparatus of claim 1, wherein the nail clipper further comprises:

a first arm and a second arm being coupled together at joined ends of the first and second arms, each one of the first and second arms having an uncoupled end, the uncoupled ends of the first and second arms being positioned adjacent to each other and being biased away from each other; and a pin being coupled to and extending away from the first arm, the pin extending through the second arm;

wherein the first blade is coupled to the uncoupled end of the first arm, the second blade being coupled to the uncoupled end of the second arm, shearing edges of the first and second blades facing toward each other; and wherein the lever is pivotally coupled to the pin opposite the first arm, the lever being movable against the second arm to move the first and second blades toward each other.

4. The apparatus of claim 1, wherein the actuator comprises:

an actuator handle being pivotally coupled to the rod, the actuator handle being positioned closer to the top end of the rod than the bottom end;

a slider being slidably coupled to the rod; and a link being pivotally coupled to and extending between the actuator handle and the slider;

wherein the actuator handle is movable toward the rod to urge the slider via the link to move the lever of the nail clipper.

5. The apparatus of claim 4, wherein:

the rod defines an opening in the perimeter surface adjacent to the bottom end;

the slider of the actuator is positioned in the rod; and the lever extends through the opening of the perimeter surface of the rod when the nail clipper is coupled to the rod.

6. The apparatus of claim 1, wherein the abrasion tool comprises a rasp comprising a rasp handle and a rasp head, the rasp handle being coupled to the rasp head, the rasp head having a plurality of cutting edges, the rasp head being configured to abrasively engage the sole of the foot.

7. The apparatus of claim 1, wherein the abrasion tool comprises a scrubber comprising a scrubber handle and a scrubber head, the scrubber head comprising an abrasive material such that the scrubber head is configured to abrade the sole of the foot.

8. The apparatus of claim 1, wherein the mount further comprises a position lock being coupled to the first member and the second member to secure the first member with respect to the second member.

9. The apparatus of claim 1, further comprising a grip being coupled to the rod, the grip being extending around the perimeter surface of the rod, the grip being positioned on a central portion of the rod.

10. The apparatus of claim 1, further comprising a magnifying glass being coupled to the rod adjacent to the bottom end, the magnifying glass being positioned over the first and second blades of the nail clipper.

11. The apparatus of claim 10, wherein the magnifying glass is pivotable with respect to the rod.

12. The apparatus of claim 1, further comprising a camera being coupled to the rod and being positionable to face the first and second blades of the nail clipper, the camera being configured to transmit a video to an electronic device.

13. The apparatus of claim 12, further comprising a support being coupled to the camera and the rod, the support coupling the camera to the rod, the support comprising a plastically bendable material such that the support retains a selected shape.

14. A foot treatment apparatus comprising:

a rod, the rod having a perimeter surface extending between a top end and a bottom end of the rod;

a nail clipper being coupled to the rod at the bottom end, the nail clipper comprising a first blade, a second blade, and a lever, the lever being movable to move the first and second blades toward each other; and an actuator being mounted to the rod, the actuator being operable to move the lever of the nail clipper to urge the first and second blades toward each other when the nail clipper is coupled to the rod;

a camera being coupled to the rod and being positionable to face the first and second blades of the nail clipper, the camera being configured to transmit a video to an electronic device;

an electrical cord being coupled to the camera, the electrical cord extending from the camera, into the rod through the bottom end, and out of the rod through the top end, a free end of the electrical cord being configured to electrically couple to the electronic device to transmit video to the electronic device and receive operational commands from the electronic device via the electrical cord; and a device holder being coupled to the rod adjacent to the top end, the device holder comprising a magnet wherein the device holder is configured to hold the electronic device via magnetic adhesion.

15. A foot treatment apparatus comprising:

a rod, the rod having a perimeter surface extending between a top end and a bottom end of the rod, the rod defining an opening in the perimeter surface adjacent to the bottom end;

a pair of nail clippers being interchangeably couplable to the rod at the bottom end, each nail clipper of the pair of nail clippers comprising:

a first arm and a second arm being coupled together at joined ends of the first and second arms, each one of the first and second arms having an uncoupled end, the uncoupled ends of the first and second arms being positioned adjacent to each other and being biased away from each other;

a first blade and a second blade, the first blade being coupled to the uncoupled end of the first arm, the second blade being coupled to the uncoupled end of the second arm, shearing edges of the first and second blades facing toward each other;

a pin being coupled to and extending away from the first arm, the pin extending through the second arm;

a lever being pivotally coupled to the pin opposite the first arm, the lever being movable against the first arm to move the first and second blades toward each other, the lever extending through the opening of the perimeter surface of the rod when the nail clipper is coupled to the rod; and a spacer being coupled to a front surface of the first blade, the spacer being configured to abut skin of a toe and retain the skin away from the shearing edge of the first blade;

wherein the first blades of the pair of nail clippers differ in length with respect to each other, the second blades of the pair of nail clippers differing in length with respect to each other;

an actuator being mounted to the rod, the actuator being operable to move the lever of a selected nail clipper of the pair of nail clippers against the first arm of the selected nail clipper when the selected nail clipper is coupled to the rod, the actuator comprising:

an actuator handle being pivotally coupled to the rod, the actuator handle being positioned closer to the top end of the rod than the bottom end;

a slider being slidably coupled to the rod, the slider being positioned in the rod; and a link being pivotally coupled to and extending between the actuator handle and the slider;

wherein the actuator handle is movable toward the rod to urge the slider via the link to move the lever of the selected nail clipper against the second arm of the selected nail clipper when the selected nail clipper is coupled to the rod;

a pair of abrasion tools being interchangeably couplable to the rod at the bottom end, the pair of abrasion tools including:

a rasp comprising a rasp handle and a rasp head, the rasp handle being coupled to the rasp head, the rasp head having a plurality of cutting edges; and a scrubber comprising a scrubber handle and a scrubber head, the scrubber head comprising an abrasive material such that the scrubber head is configured to abrade a sole of a foot;

a mount being coupled to the rod at the bottom end, the mount comprising:

a first member being fixedly attached to the rod;

a second member being pivotally coupled to the first member;

a sleeve being coupled to the second member, the pair of abrasion tools being interchangeably insertable into the sleeve; and a position lock being coupled to the first member and the second member to secure the first member with respect to the second member;

wherein the mount is movable to move a selected abrasion tool of the pair of abrasion tools between a first position and a second position when the selected abrasion tool is held in the sleeve, the selected abrasion tool lying adjacent to the rod when the abrasion tool is positioned in the first position, the selected abrasion tool extending perpendicularly away from the rod when the abrasion tool is positioned in the second position;

a grip being coupled to the rod, the grip being extending around the perimeter surface of the rod, the grip being positioned on a central portion of the rod; and a clipper connector being interchangeably connectable to either one of the pair of nail clippers to couple either nail clipper to the rod, the clipper connector comprising a nut and a bolt having complementary threads.

16. The apparatus of claim 15, further comprising a magnifying glass being coupled to the rod adjacent to the bottom end, the magnifying glass being positioned over the first and second blades of the selected nail clipper when the selected nail clipper is coupled to the rod, the magnifying glass being pivotable with respect to the rod.

17. The apparatus of claim 15, further comprising:

a camera being coupled to the rod and being positionable to face the first and second blades of the selected nail clipper when the nail clipper is coupled to the rod;

a support being coupled to the camera and the rod, the support coupling the camera to the rod, the support comprising a plastically bendable material such that the support retains a selected shape;

an electrical cord being coupled to the camera, the electrical cord extending from the camera, into the rod through the bottom end, and out of the rod through the top end, a free end of the electrical cord being configured to electrically couple to an electronic device to transmit video to the electronic device and receive operational commands from the electronic device via the electrical cord; and a device holder being coupled to the rod adjacent to the top end, the device holder comprising a magnet wherein the device holder is configured to hold the electronic device via magnetic adhesion.

* * * * *